US006128982A

United States Patent [19]

Gwin, Sr.

[11] Patent Number: 6,128,982

[45] Date of Patent: Oct. 10, 2000

[54] SPRING-LOADED SCREWDRIVER WITH COVER AND CHANGEABLE HEADS

[76] Inventor: Arthur C. Gwin, Sr., 324 Kidwelly Ct., Exton, Pa. 19341

[21] Appl. No.: 09/058,398

[22] Filed: Apr. 9, 1998

[51] Int. Cl.[7] ..... B25B 23/08

[52] U.S. Cl. ..... 81/452; 81/438

[58] Field of Search ..... 81/451, 452, 456, 81/457, 437, 438, 439

[56] References Cited

U.S. PATENT DOCUMENTS

| | | | |
|---|---|---|---|
| 701,941 | 6/1902 | Rowlands | 81/451 |
| 909,723 | 1/1909 | Wiesedeppe | 81/451 |
| 1,779,339 | 10/1930 | Sokoloff | 81/452 |
| 2,544,834 | 3/1951 | Hancock | 81/451 |
| 2,735,325 | 2/1956 | Rudd, Sr. | 81/439 |
| 2,780,257 | 2/1957 | Duggan | 81/451 |
| 3,245,446 | 4/1966 | Morifuji | 81/452 |
| 4,526,072 | 7/1985 | Manhoff, Jr. | 81/451 |
| 4,800,788 | 1/1989 | Goldstein | 81/451 |
| 5,129,292 | 7/1992 | Albert | 81/452 |
| 5,458,030 | 10/1995 | Betts | 81/451 |

*Primary Examiner*—David A. Scherbel
*Assistant Examiner*—Joni B. Danganan

[57] ABSTRACT

A spring-loaded screwdriver with cover and changeable heads for covering an entire screw to guide it directly into its threading hole. The device includes a handle portion having an outer end and an inner end. An outer cylinder is secured to the outer end of the handle portion. The outer cylinder has a closed inner end, an open outer end and a cylindrical side wall therebetween. The outer cylinder has a spring disposed interiorly thereof. An inner cylinder is slidably received within the open outer end of the outer cylinder. The inner cylinder has an open inner end and an open outer end. The open inner end of the inner cylinder abuts an outer end of the spring. A magnetized shaft is secured to the inner end of the cylindrical handle and extends within the outer cylinder and through the spring. The magnetized shaft has a hexagonal shaped recess formed within a free end thereof. A plurality of changeable heads are provided with each having inner hexagonal shaped end portions for being removably received within the hexagonal shaped recess of the magnetized shaft.

4 Claims, 2 Drawing Sheets

SPRING-LOADED SCREWDRIVER WITH COVER AND CHANGEABLE HEADS

BACKGROUND OF THE INVENTION

1. Field of the Invention

The present invention relates to screwdrivers and more particularly pertains to a new spring-loaded screwdriver with cover and changeable heads for covering an entire screw to guide it directly into its threading hole.

2. Description of the Prior Art

The use of screwdrivers is known in the prior art. More specifically, screwdrivers heretofore devised and utilized are known to consist basically of familiar, expected and obvious structural configurations, notwithstanding the myriad of designs encompassed by the crowded prior art which have been developed for the fulfillment of countless objectives and requirements.

Known prior art screwdrivers include U.S. Pat. No. 5,355,752 to Keenan et al.; U.S. Pat. No. 4,736,658 to Jore; U.S. Pat. No. 4,016,913 to Anderson; U.S. Pat. No. 5,003,850 to Harkins; U.S. Pat. No. 5,056,387 to Cook; and U.S. Pat. No. Des. 307,697 to Geckle.

While these devices fulfill their respective, particular objectives and requirements, the aforementioned patents do not disclose a new spring-loaded screwdriver with cover and changeable heads. The inventive device includes a handle portion having an outer end and an inner end. An outer cylinder is secured to the outer end of the handle portion. The outer cylinder has a closed inner end, an open outer end and a cylindrical side wall therebetween. The outer cylinder has a spring disposed interiorly thereof. An inner cylinder is slidably received within the open outer end of the outer cylinder. The inner cylinder has an open inner end and an open outer end. The open inner end of the inner cylinder abuts an outer end of the spring. A magnetized shaft is secured to the inner end of the cylindrical handle and extends within the outer cylinder and through the spring. The magnetized shaft has a hexagonal shaped recess formed within a free end thereof. A plurality of changeable heads are provided with each having inner hexagonal shaped end portions for being removably received within the hexagonal shaped recess of the magnetized shaft.

In these respects, the spring-loaded screwdriver with cover and changeable heads according to the present invention substantially departs from the conventional concepts and designs of the prior art, and in so doing provides an apparatus primarily developed for the purpose of covering an entire screw to guide it directly into its threading hole.

SUMMARY OF THE INVENTION

In view of the foregoing disadvantages inherent in the known types of screwdrivers now present in the prior art, the present invention provides a new spring-loaded screwdriver with cover and changeable heads construction wherein the same can be utilized for covering an entire screw to guide it directly into its threading hole.

The general purpose of the present invention, which will be described subsequently in greater detail, is to provide a new spring-loaded screwdriver with cover and changeable heads apparatus and method which has many of the advantages of the screwdrivers mentioned heretofore and many novel features that result in a new spring-loaded screwdriver with cover and changeable heads which is not anticipated, rendered obvious, suggested, or even implied by any of the prior art screwdrivers, either alone or in any combination thereof.

To attain this, the present invention generally comprises a handle portion having a generally cylindrical configuration. The handle portion has an outer end and an inner end. An outer cylinder is secured to the outer end of the handle portion. The outer cylinder has a closed inner end, an open outer end and a cylindrical side wall therebetween. The cylindrical side wall has an elongated slot therethrough. The open upper end has a peripheral flange disposed therearound. The outer cylinder has a spring disposed interiorly thereof. An inner cylinder is slidably received within the open outer end of the outer cylinder. The inner cylinder has an open inner end and an open outer end. The inner cylinder has a rubber star grommet disposed interiorly thereof inwardly of the open outer end thereof. The open inner end of the inner cylinder abuts an outer end of the spring. The inner cylinder has a pin extending outwardly therefrom for being received within the elongated slot of the outer cylinder. A magnetized shaft is secured to the inner end of the cylindrical handle and extends within the outer cylinder and through the spring. The magnetized shaft has a hexagonal shaped recess formed within a free end thereof. A plurality of changeable heads are provided with each having inner hexagonal shaped end portions for being removably received within the hexagonal shaped recess of the magnetized shaft. The changeable heads include a Phillips head screwdriver, a slot head screwdriver, a square adapter, and a hex adapter.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new spring-loaded screwdriver with cover and changeable heads apparatus and method which has many of the advantages of the screwdrivers mentioned heretofore and many novel features that result in a new spring-loaded screwdriver with cover and changeable heads which is not anticipated, rendered obvious, suggested, or even implied by any of the prior art screwdrivers, either alone or in any combination thereof.

It is another object of the present invention to provide a new spring-loaded screwdriver with cover and changeable heads which may be easily and efficiently manufactured and marketed.

It is a further object of the present invention to provide a new spring-loaded screwdriver with cover and changeable heads which is of a durable and reliable construction.

An even further object of the present invention is to provide a new spring-loaded screwdriver with cover and changeable heads which is susceptible of a low cost of manufacture with regard to both materials and labor, and which accordingly is then susceptible of low prices of sale to the consuming public, thereby making such spring-loaded screwdriver with cover and changeable heads economically available to the buying public.

Still yet another object of the present invention is to provide a new spring-loaded screwdriver with cover and changeable heads which provides in the apparatuses and methods of the prior art some of the advantages thereof, while simultaneously overcoming some of the disadvantages normally associated therewith.

Still another object of the present invention is to provide a new spring-loaded screwdriver with cover and changeable heads for covering an entire screw to guide it directly into its threading hole.

Yet another object of the present invention is to provide a new spring-loaded screwdriver with cover and changeable heads which includes a handle portion having an outer end and an inner end. An outer cylinder is secured to the outer end of the handle portion. The outer cylinder has a closed inner end, an open outer end and a cylindrical side wall therebetween. The outer cylinder has a spring disposed interiorly thereof. An inner cylinder is slidably received within the open outer end of the outer cylinder. The inner cylinder has an open inner end and an open outer end. The open inner end of the inner cylinder abuts an outer end of the spring. A magnetized shaft is secured to the inner end of the cylindrical handle and extends within the outer cylinder and through the spring. The magnetized shaft has a hexagonal shaped recess formed within a free end thereof. A plurality of changeable heads are provided with each having inner hexagonal shaped end portions for being removably received within the hexagonal shaped recess of the magnetized shaft.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
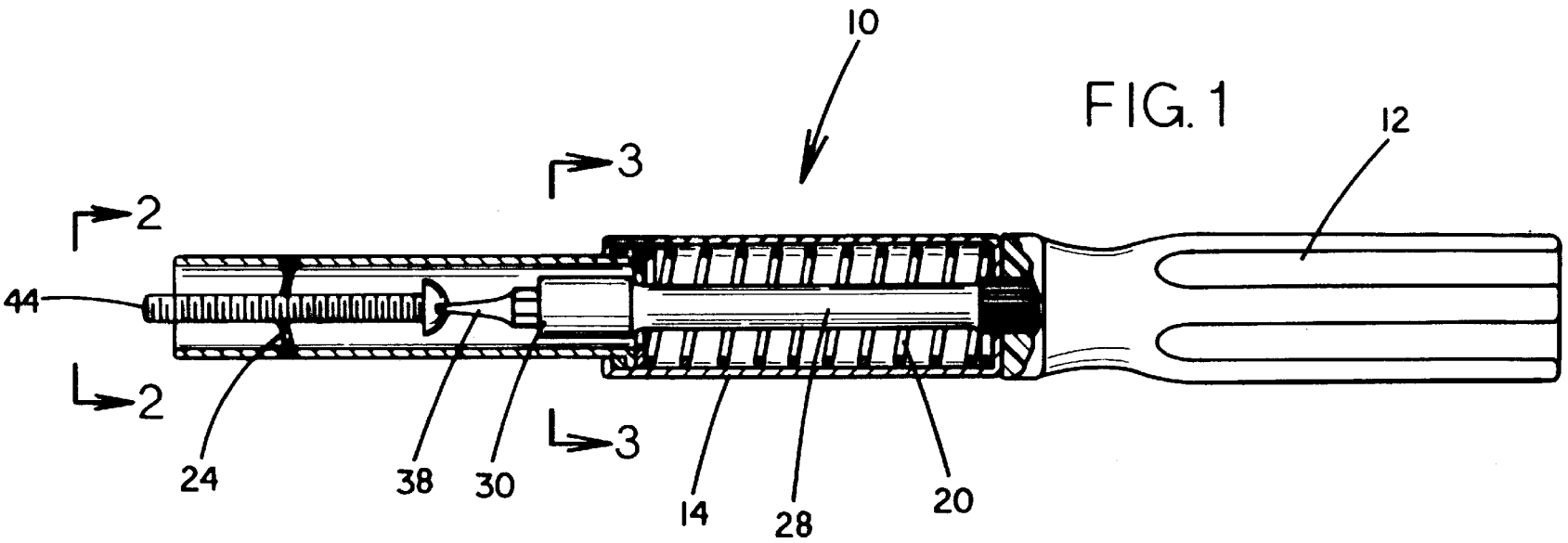
FIG. 1 is a side view of a new spring-loaded screwdriver with cover and changeable heads according to the present invention shown in partial cross-section.
Figure 3:
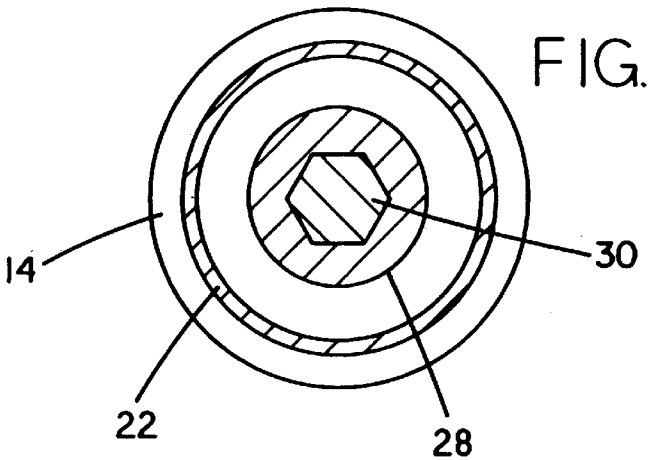
FIG. 3 is a cross-sectional view of the present invention as taken along line 3—3 of FIG. 1.
Figure 2:
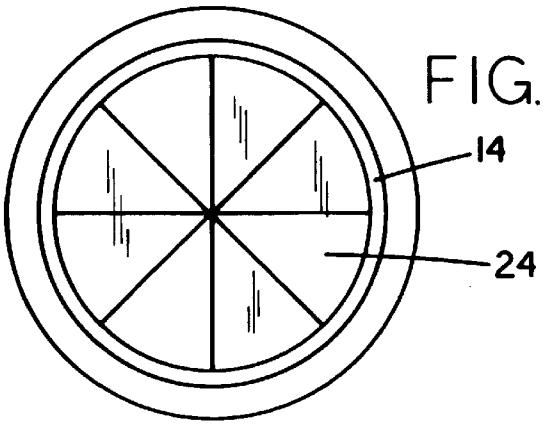
FIG. 2 is a cross-sectional view of the present invention as taken along line 2—2 of FIG. 1.
Figure 4:
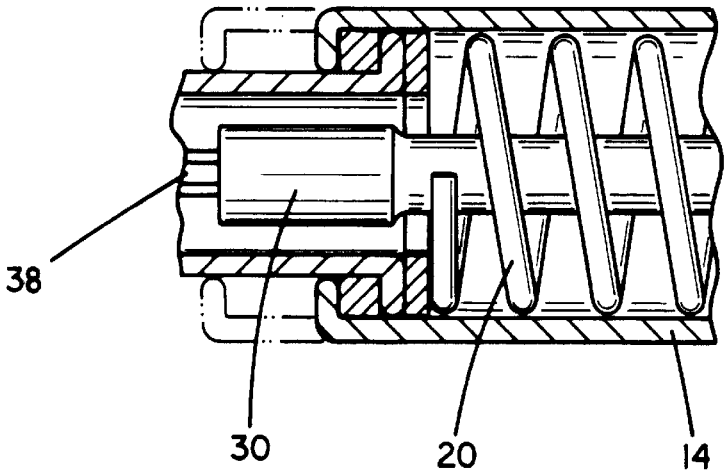
FIG. 4 is an enlarged partial plan view of the present invention as taken along line 4—4 of FIG. 1.
Figure 5:
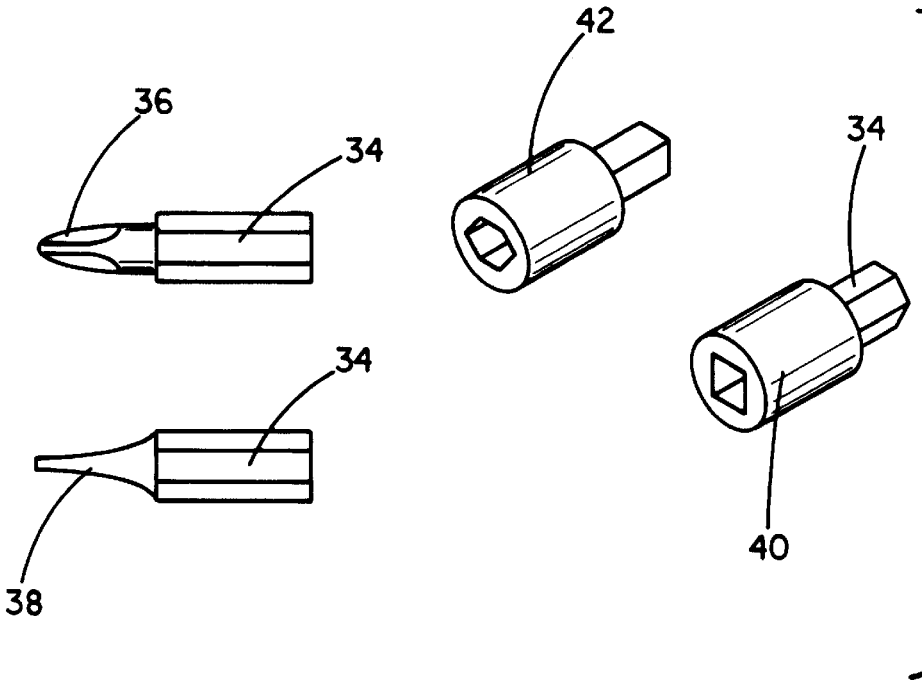
FIG. 5 is a perspective view of the changeable heads of the present invention.

With reference now to the drawings, and in particular to FIGS. 1 through 5 thereof, a new spring-loaded screwdriver with cover and changeable heads embodying the principles and concepts of the present invention and generally designated by the reference numeral 10 will be described.

As best illustrated in FIGS. 1 through 5, the spring-loaded screwdriver with cover and changeable heads 10 comprises a handle portion 12 having a generally cylindrical configuration. The handle portion 12 has an outer end and an inner end.

An outer cylinder 14 is secured to the outer end of the handle portion 12. The outer cylinder 14 has a closed inner end, an open outer end and a cylindrical side wall therebetween. The open upper end has a peripheral flange 18 disposed therearound. The outer cylinder 14 has a spring 20 disposed interiorly thereof.

An inner cylinder 22 is slidably received within the open outer end of the outer cylinder 14. The inner cylinder 22 has an open inner end and an open outer end. The inner cylinder 22 has a rubber star grommet 24 disposed interiorly thereof inwardly of the open outer end thereof. The open inner end of the inner cylinder 22 abuts an outer end of the spring 20.

A magnetized shaft 28 is secured to the inner end of the cylindrical handle 12 and extends within the outer cylinder 14 and through the spring 20. The magnetized shaft 28 has a hexagonal shaped recess 30 formed within a free end thereof.

A plurality of changeable heads are provided with each having inner hexagonal shaped end portions 34 for being removably received within the hexagonal shaped recess 30 of the magnetized shaft 28. The changeable heads include a Phillips head screwdriver 36, a slot head screwdriver 38, a square adapter 40, and a hex adapter 42. The changeable heads are all fabricated of metal to maintain the properties of the magnetized shaft 28.

In use, the tool user would select the type of head desired and insert it into the recess 30 of the magnetized shaft 28. The user would then insert a screw 44 corresponding to the type of head into the inner cylinder 22 and through the rubber star grommet 24 to engage the head. The grommet 24 would help hold the screw 44 in position while using the device 10. The open outer end of the inner cylinder 22 is then placed over the threaded hole that will receive the screw 44. The user will then press inwardly on the device 10 causing the inner cylinder 22 to slide inwardly against the urging of the spring 20 thereby allowing the screw 44 to enter the threaded hole or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spring-loaded screwdriver with cover and changeable heads for covering an entire screw to guide it directly into its threading hole comprising, in combination:

a handle portion having a substantially cylindrical configuration, the handle portion having an outer end and an inner end;

an outer cylinder secured to the outer end of the handle portion, the outer cylinder having an inner end, an open outer end and a cylindrical side wall therebetween, the open outer end having a peripheral flange disposed therearound, the outer cylinder having a spring disposed interiorly thereof;

an inner cylinder slidably received within the open outer end of the outer cylinder, the inner cylinder having an open inner end and an open outer end, the inner cylinder having a rubber star grommet disposed interiorly thereof inwardly of the open outer end thereof, the open inner end of the inner cylinder abutting an outer end of the spring;

a magnetized shaft secured to the inner end of the handle portion and extending within the outer cylinder and through the spring, the magnetized shaft having a hexagonal shaped recess formed within a free end thereof; and a plurality of changeable heads each having inner hexagonal shaped end portions for being removably received within the hexagonal shaped recess of the magnetized shaft, the changeable heads including a Phillips head screwdriver, a slot head screwdriver, a square adapter, and a hex adapter.

2. A spring-loaded screwdriver with cover and changeable heads for covering an entire screw to guide it directly into its threading hole comprising, in combination:

a handle portion having an outer end and an inner end;

an outer cylinder secured to the outer end of the handle portion, the outer cylinder having an inner end, an open outer end and a cylindrical side wall therebetween, the outer cylinder having a spring disposed interiorly thereof;

an inner cylinder slidably received within the open outer end of the outer cylinder, the inner cylinder having an open inner end and an open outer end, the open inner end of the inner cylinder abutting an outer end of the spring, wherein the inner cylinder has a rubber star grommet disposed interiorly thereof inwardly of the open outer end thereof;

a magnetized shaft secured to the inner end of the handle portion and extending within the outer cylinder and through the spring, the magnetized shaft having a hexagonal shaped recess formed within a free end thereof; and a plurality of changeable heads each having inner hexagonal shaped end portions for being removably received within the hexagonal shaped recess of the magnetized shaft.

3. The spring-loaded screwdriver with cover and changeable heads as set forth in claim 2 wherein the changeable heads include a Phillips head screwdriver, a slot head screwdriver, a square adapter, and a hex adapter.

4. A spring-loaded screwdriver with cover and changeable heads for covering a screw to guide it directly into its threading hole comprising, in combination:

a handle portion having an outer end and an inner end;

an outer cylinder secured to the outer end of the handle portion, the outer cylinder having an inner end, an open outer end and a cylindrical side wall therebetween, the outer cylinder having a spring disposed interiorly thereof;

an inner cylinder slidably received in the open outer end of the outer cylinder, the inner cylinder having an open inner end and an open outer end, the open inner end of the inner cylinder abutting an outer end of the spring, wherein the inner cylinder has a star grommet disposed in the interior thereof and positioned inwardly of the open outer end of the cylinder;

a magnetized shaft secured to the inner end of the handle portion and extending in the outer cylinder and through the spring, the magnetized shaft having a hexagonal shaped recess formed in a free end thereof; and a plurality of changeable heads each having inner hexagonal shaped end portions for being removably received in the hexagonal shaped recess of the magnetized shaft.

* * * * *